US008732976B2

(12) United States Patent
Han et al.

(10) Patent No.: US 8,732,976 B2
(45) Date of Patent: May 27, 2014

(54) ROTATING AIR DIRECTING APPARATUS FOR A HAIR DRYER

(71) Applicant: Kiss Nail Products, Inc., Port Washington, NY (US)

(72) Inventors: Kyusang Han, Port Washington, NY (US); Kyoung Hak Lee, Plainview, NY (US); Won Seok Oh, Port Washington, NY (US)

(73) Assignee: Kiss Nail Products, Inc., Fort Washington, NY (US)

( * ) Notice: Subject to any disclaimer, the term of this patent is extended or adjusted under 35 U.S.C. 154(b) by 0 days.

(21) Appl. No.: 13/720,299

(22) Filed: Dec. 19, 2012

(65) Prior Publication Data

US 2013/0104415 A1 May 2, 2013

Related U.S. Application Data

(63) Continuation-in-part of application No. 13/088,005, filed on Apr. 15, 2011, and a continuation-in-part of application No. 13/564,267, filed on Aug. 1, 2012, which is a continuation-in-part of application No. 13/088,005, filed on Apr. 15, 2011, application No. 13/720,299, which is a continuation-in-part of application No. 29/423,264, filed on May 30, 2012, which is a continuation-in-part of application No. 13/088,005, filed on Apr. 15, 2011.

(51) Int. Cl.
*A45D 20/12* (2006.01)
*A45D 20/00* (2006.01)

(52) U.S. Cl.
USPC ..... 34/96; 34/283; 34/97

(58) Field of Classification Search
USPC ..... 34/283, 96–99, 101, 638, 642; 132/212; 219/222; 392/379–385; 239/601, 589, 239/590, 590.5
See application file for complete search history.

(56) References Cited

U.S. PATENT DOCUMENTS

| | | | | |
|---|---|---|---|---|
| 4,308,670 | A | 1/1982 | Bonnema | |
| 4,878,620 | A | 11/1989 | Tarleton | |
| 5,054,211 | A | 10/1991 | Shulman | |
| 5,091,630 | A * | 2/1992 | Djuric | 34/97 |
| 5,161,317 | A | 11/1992 | McDougall | |
| 5,471,763 | A * | 12/1995 | McArthur | 34/96 |
| 5,473,824 | A * | 12/1995 | Prehodka | 34/97 |
| 5,689,896 | A | 11/1997 | Smetana | |
| 5,725,159 | A * | 3/1998 | Dorber et al. | 239/553.3 |
| D398,074 | S | 9/1998 | Nosenchuck | |

(Continued)

FOREIGN PATENT DOCUMENTS

| | | |
|---|---|---|
| JP | 2004176597 | 6/2004 |
| JP | 2006075194 | 3/2006 |

*Primary Examiner* — Kenneth Rinehart
*Assistant Examiner* — John McCormack
(74) *Attorney, Agent, or Firm* — Proskauer Rose LLP

(57) ABSTRACT

The invention provides, in some aspects, apparatus and methods for a rotating airflow directing attachment for a barrel of a hair dryer. The attachment includes a tubular adapter (or "attachment body") having an inlet opening and an outlet opening, wherein the inlet opening is adapted to be removably coupled to the barrel of the hair dryer. A blade is rotatably coupled to the tubular adapter, and a nozzle is disposed adjacent to the outlet opening of the tubular adapter and adapted to rotate with the blade. The nozzle has an opening disposed at an acute angle relative to the outlet opening of the tubular adapter.

28 Claims, 14 Drawing Sheets

(56) References Cited

U.S. PATENT DOCUMENTS

| | | | | |
|---|---|---|---|---|
| 5,841,943 | A * | 11/1998 | Nosenchuck | 392/385 |
| 6,011,903 | A | 1/2000 | Nosenchuck | |
| 6,041,514 | A | 3/2000 | Herzog | |
| 6,199,295 | B1 | 3/2001 | Smal et al. | |
| 6,966,125 | B2 | 11/2005 | Rago et al. | |
| 7,178,261 | B2 | 2/2007 | McCambridge et al. | |
| 7,334,988 | B2 | 2/2008 | Horng et al. | |
| 8,082,679 | B1 * | 12/2011 | Arnim | 34/97 |
| 2004/0168337 | A1 | 9/2004 | Curtin | |
| 2005/0072019 | A1 | 4/2005 | Rago et al. | |
| 2010/0307019 | A1 * | 12/2010 | Park et al. | 34/90 |
| 2011/0162225 | A1 | 7/2011 | Obermann et al. | |

* cited by examiner

ROTATING AIR DIRECTING APPARATUS FOR A HAIR DRYER

RELATED APPLICATIONS

This application claims the benefit of priority of U.S. patent application Ser. No. 13/564,267, filed Aug. 1, 2012, and U.S. patent application Ser. No. 13/088,005, filed Apr. 15, 2011, and U.S. patent application Ser. No. 29/423,264 filed May 30, 2012. The entirety of all three applications is incorporated herein by reference.

BACKGROUND OF THE INVENTION

1. Field of the Invention

The invention relates generally to the field of hair dryers, and more particularly, to devices having a rotating member for directing a circular flow of air from a hair dryer.

2. Description of the Related Art

A number of devices are known that direct air flow from a hair dryer. These devices include nozzle attachments or outlets that spin while deflecting air at an acute angle. The attachments are enabled to spin through the use of internal vanes that are pushed by the air exiting the hair dryer. The vanes are typically connected to and spin around a central point within the attachment. The direction of the air exiting the rotating attachment is thereby constantly changed, sometimes in a circular pattern. However, the air flow exiting from the attachment remains linear by nature, and the vanes only act to change how the linear flow is directed.

SUMMARY OF THE INVENTION

The present invention has been made to address at least the above problems and/or disadvantages and to provide at least the advantages described below. Accordingly, an aspect of the present invention relates to a rotating member for directing a circular flow of air from a portable hand-held hair dryer.

According to one aspect of the present invention, a rotating air directing apparatus for a barrel of a hair dryer is provided. The apparatus includes a tubular adapter member adapted to be removably coupled to the barrel of the hair dryer. The apparatus also includes a tubular rotating member rotatably coupled to the tubular adapter member. The tubular rotating member includes a circumferential inner surface, an inlet opening, an outlet opening, and a plurality of curved vanes. The apparatus further includes a nozzle member disposed adjacent to the outlet opening of the tubular rotating member and adapted to rotate with the tubular rotating member. The nozzle member includes an angled tubular member having a nozzle opening disposed at an acute angle relative to the outlet opening. The plurality of curved vanes each have a fixed edge at the circumferential inner surface that extends from the inlet opening to the outlet opening of the tubular rotating member, and an opposing free edge that defines a central open space of the tubular rotating member. Each of the plurality of curved vanes is spaced apart from adjacent vanes, thereby defining a plurality of curved radial openings between adjacent curved vanes. Each of the plurality of curved radial openings adjoins the central open space to form a continuous open path.

According to another aspect of the present invention, a hair dryer assembly is provided. The assembly includes a hair dryer having a barrel, and a tubular rotating member rotatably coupled to the barrel. The tubular rotating member includes a circumferential inner surface, an inlet opening, an outlet opening, and a plurality of curved vanes. The assembly further includes a nozzle member disposed adjacent to the outlet opening of the tubular rotating member and adapted to rotate with the tubular rotating member. The nozzle member includes an angled tubular member having a nozzle opening disposed at an acute angle relative to the outlet opening. The plurality of curved vanes each have a fixed edge at the circumferential inner surface that curvedly extends from the inlet opening to the outlet opening of the tubular rotating member, and an opposing free edge that defines a central open space of the tubular rotating member that remains open when rotating. Each of the plurality of curved vanes is spaced apart from adjacent vanes, thereby defining a plurality of curved radial openings between adjacent curved vanes. Each of the plurality of curved radial openings adjoins the central open space to form a continuous open path.

In another aspect of the invention, a rotating airflow directing attachment for a barrel of a hair dryer includes a tubular adapter having an inlet opening and an outlet opening, wherein the inlet opening is adapted to be removably coupled to the barrel of the hair dryer. A blade is rotatably coupled to the tubular adapter, and a nozzle disposed adjacent to the outlet opening of the tubular adapter and adapted to rotate with the blade, wherein the nozzle has an opening disposed at an acute angle relative to the outlet opening of the tubular adapter.

Related aspects of the invention provide one or more blades, at least one of which is curved.

Further related aspects of the invention provide the nozzle having a semi-conical and/or frusto-conical shape. Still further related aspects of the invention provide the nozzle either (i) rigidly coupled to the tubular adapter, or (ii) integrally formed with the tubular adapter in a single unitary structure.

Still further related aspects of the invention provide the tubular adapter configured to reduce a temperature of the attachment.

Still further related aspects of the invention provide the nozzle opening disposed such that a perpendicular line passing through a center of the nozzle opening forms an angle of less than ninety degrees with an perpendicular line passing though a center of the outlet opening of the tubular adapter.

Still further related aspects of the invention provide the nozzle configured to produce, through the outlet opening of the nozzle, a moving, rotating pattern of heated air flow similar to that achieved when an operator manually manipulates the hair dryer relative to hair to be dried.

Still further related aspects of the invention provide the nozzle configured to produce, through an outlet opening of the nozzle, an airflow having a toroidal shape.

Still further related aspects of the invention provide the blade disposed within a rotating member that is rotatably coupled to the tubular adapter.

Still further related aspects of the invention provide the blade integrally formed within the tubular adapter, and the nozzle is rigidly attached the tubular adapter. Related aspects of the invention provide the rotating member secured to an outside portion of the attachment through a pivot structure.

In yet another aspect of the invention, a method is provided for directing airflow of a hair dryer with an attachment, the method including receiving, in an inlet opening of a tubular adapter, an airflow from the hair dryer. The method further includes directing the airflow to rotate a blade disposed within the tubular adapter, the airflow being directed through an outlet opening of the tubular adapter and into an inlet opening of a nozzle disposed adjacent thereto, causing the nozzle to rotate; and further directing the airflow through an outlet opening of the nozzle, the outlet opening being disposed at an acute angle relative to the outlet opening of the tubular adapter.

Further related aspects of the invention provide the airflow exiting the outlet opening of the nozzle has a moving, rotating pattern of heated air flow similar to that achieved when an operator manually manipulates the hair dryer relative to hair to be dried. Yet further related aspects provide the airflow exiting the outlet opening of the nozzle is toroidal in shape.

Still further related aspects of the invention provide reducing a temperature of an outside portion of the attachment with the tubular adapter.

Still further related aspects of the invention provide a configuration of the nozzle and blade which causes a pulsating airflow from the outlet by rotating the nozzle and/or blade at a speed of between 1500 RPM and 2500 RPM.

BRIEF DESCRIPTION OF THE DRAWINGS

The above and other aspects, features and advantages of the present invention will be apparent from the following detailed description when taken in conjunction with the accompanying drawings, in which.

DETAILED DESCRIPTION

Figure 3:
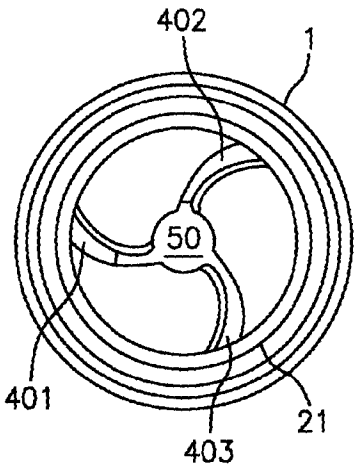
FIG. 3 is a diagram illustrating a rear view of the apparatus shown in FIGS. 1 and 2, according to an embodiment of the present invention.
Figure 2:
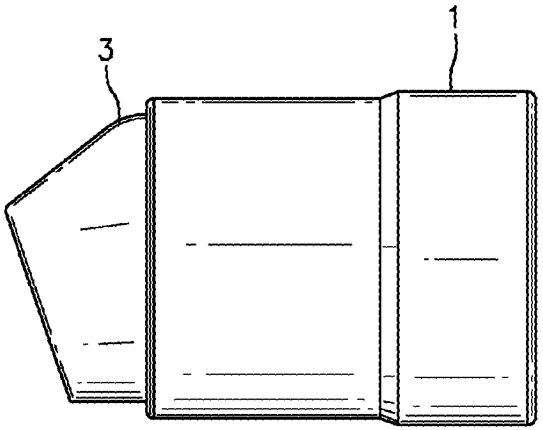
FIG. 2 is a diagram illustrating a side view of the apparatus shown in FIG. 1, according to an embodiment of the present invention.
Figure 1:
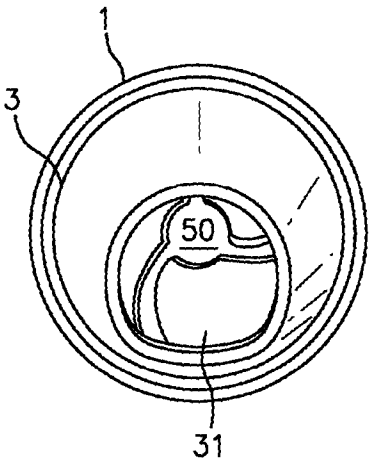
FIG. 1 is a diagram illustrating a front view of a rotating air directing apparatus, according to an embodiment of the invention.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

FIGS. 1-4 and 6-12B show a rotating air directing apparatus for a barrel of a hair dryer, according to embodiments of the present invention. FIG. 5 shows a hair dryer assembly including a rotating air directing apparatus, according to an embodiment of the present invention. The air directing apparatus may be an attachment adapted to be removably secured to the barrel of a hair dryer as shown, for example in FIGS. 1-4 and 6-12B, or may be integral with a hair dryer barrel itself, as shown for example in FIG. 5. A hair dryer is preferably a handheld portable hair dryer typically used at home or in a salon.

The rotating air directing apparatus is powered by the force of the air flowing from the hair dryer. The apparatus is designed and configured to create a moving, rotating pattern of heated air flow similar to that achieved when an operator manually manipulates the hair dryer relative to the hair to be dried. A rotating air directing apparatus, or a hair dryer assembly, according to an embodiment of the invention, eliminates the need for the operator to continuously manipulate the hair dryer, thereby reducing operator fatigue.

Figure 4:
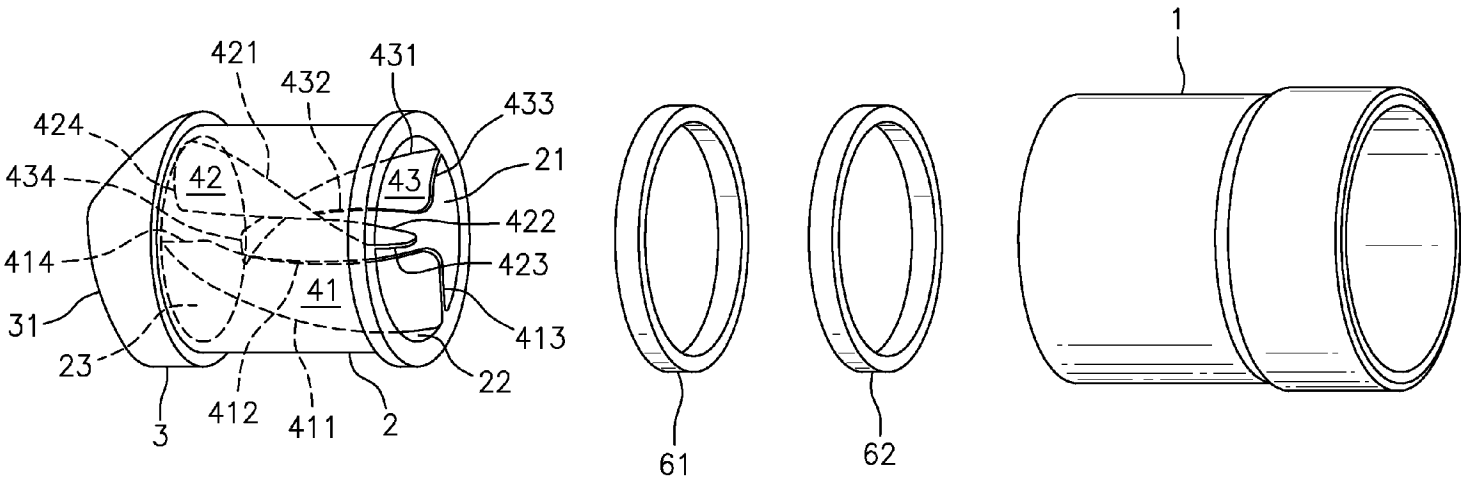
FIG. 4 is a diagram illustrating an exploded perspective view of the apparatus shown in FIGS. 1, 2 and 3, according to an embodiment of the present invention.
Figure 5:
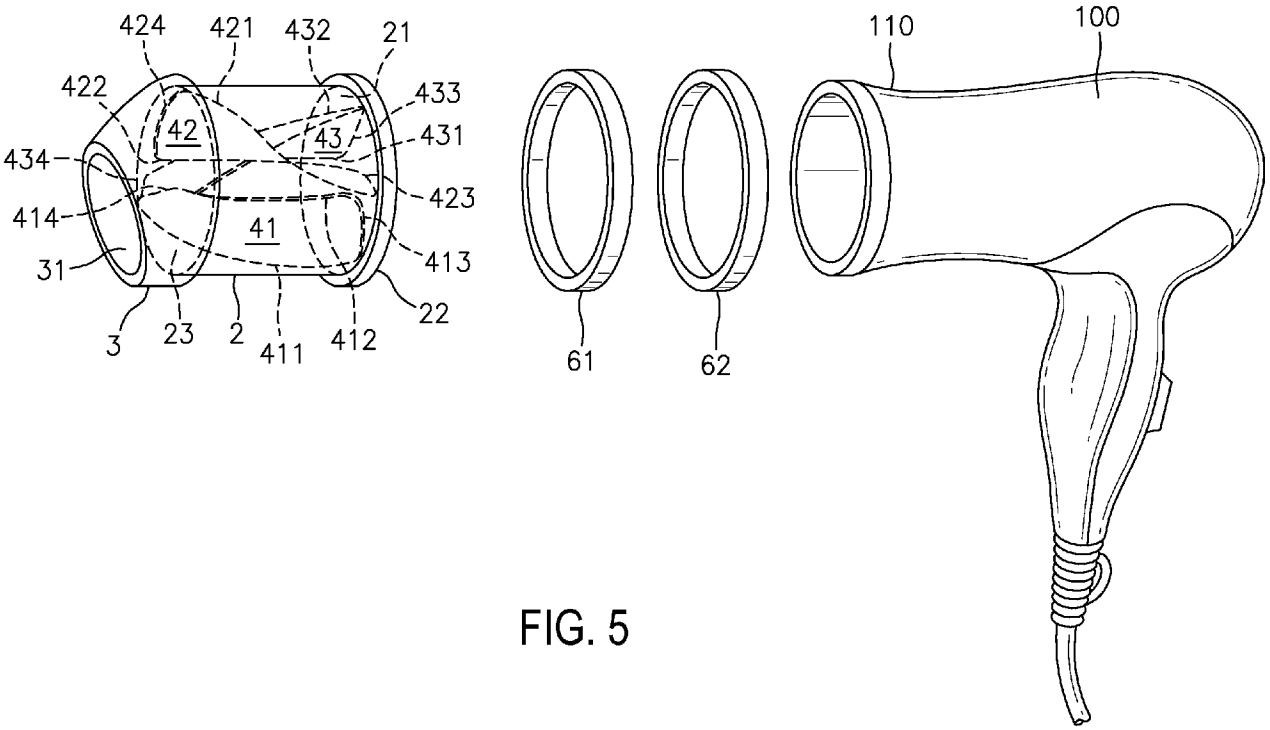
FIG. 5 is a diagram illustrating an exploded perspective view of a hair dryer assembly, according to an embodiment of the invention.

As shown, for example in FIG. 4, a rotating air directing apparatus for a barrel of a hair dryer, according to an embodiment of the invention, may include a tubular adapter member 1. The tubular adapter member 1 is adapted to be removably coupled to a barrel 110 of the hair dryer 100. For example, an internal diameter of the tubular adapter member 1 may be dimensioned to fit over an outer diameter of the hair dryer barrel 110 to provide a press-on or friction fit. Alternatively, an outer diameter of the tubular adapter member 1 may have dimensions that fit within an inner diameter of the hair dryer barrel 110 to provide a press-on or friction fit. Other possible arrangements for providing a removable coupling between the tubular adapter member 1 and the barrel 110 of the hair dryer 100 include an engaging groove on one or both of the tubular adapter member 1 and the barrel 110 of the hair dryer 100, a threaded fit and a clamping element.

The tubular adapter member 1 may be formed from a rigid, lightweight plastic material or any other suitable material or materials. The tubular adapter member 1 may have an outer diameter in a range between approximately 30 mm and 70 mm, for example approximately 53 mm, and a length in a range between approximately 40 and 80 mm, for example approximately 61 mm. However, the tubular adapter member 1 may be any suitable size for coupling to the hair dryer 100.

A tubular rotating member 2 is rotatably coupled to the tubular adapter member 1. The tubular rotating member 2 includes a circumferential inner surface 21, an inlet opening 22 and an outlet opening 23. For example, an outer diameter of the tubular rotating member 2 may be dimensioned to fit inside the tubular adapter member 1 to provide a freely rotating fit. The respective inner and outer surfaces of the tubular adapter member 1 and the tubular rotating member 2 may provide bearing surfaces for the rotational motion. Alternatively, one or more bearing elements may be incorporated into the apparatus to facilitate rotation of the tubular rotating member 2. The bearing elements may be any suitable type, for example, ring bearings, roller bearings or ball bearings. At least one ring bearing may be disposed on an inner surface of the tubular adapter member 1 and/or on an outer surface of the tubular rotating member 2. Moreover, a first ring bearing 61 may be disposed proximate to the outlet opening 23 of the tubular rotating member 2 on an outer surface of the tubular rotating member 2 and on an inner surface of the tubular adapter member 1. A second ring bearing 62 may be disposed proximate to the inlet opening 22 of the tubular rotating member 2 on an outer surface of the tubular rotating member 2 and on an inner surface of the tubular adapter member 1.

The tubular rotating member 2 may be formed from a rigid, lightweight plastic material or any other suitable material or materials. A length of the tubular adapter member 1 and the tubular rotating member 2 assembly may be in a range of approximately 60 to 100 mm, for example 82 mm. However, the assembly may be any suitable length for achieving its intended purpose.

A nozzle member 3 is disposed adjacent to the outlet opening 23 of the tubular rotating member 2 and is adapted to rotate with the tubular rotating member 2. The nozzle member 3 may be rigidly coupled to the tubular rotating member 2 or may be formed integrally therewith to provide a single unitary structure. The nozzle member 3 includes an angled tubular member, which can have, for example, a semi-conical or frusto-conical shape.

The nozzle member 3 also has a nozzle opening 31 disposed at an acute angle relative to the outlet opening 23 of the tubular rotating member 2. Specifically, a imaginary perpendicular line passing through a center of the nozzle opening 31 forms an angle of less than ninety degrees with an imaginary perpendicular line passing though a center of the outlet opening 23. Due to the configuration of the angled nozzle opening, when the tubular rotating member 2 and the nozzle member 3 rotate, a moving, rotating pattern of heated air flow is created which is similar to that achieved by an operator manually manipulating the hair dryer relative to the hair to be dried. The nozzle member 3 may be formed from a rigid, lightweight plastic material or any other suitable material or materials.

A plurality of curved vanes is disposed within the tubular rotating member 2. The rotating air directing apparatus may include two, three or more vanes. For example, as shown in FIG. 3, a first curved vane 41, a second curved vane 42 and a third curved vane 43 may be disposed within the tubular rotating member 2. The curved vanes 41, 42, 43 may be rigidly coupled to the tubular rotating member 2 or may be formed integrally therewith to provide a single unitary structure.

The curved vanes 41, 42, 43 are configured to cause the tubular rotating member 2 and the nozzle member 3 to rotate together when the air stream from the hair dryer flows past the curved vanes 41, 42, 43. The shape and arrangement of the vanes 41, 42, 43 create a vortex or whirling mass of air which imparts a rotating motion on the tubular rotating member 2 and the nozzle member 3. In particular, the plurality of curved vanes 41, 42, 43 includes a corresponding plurality of fixed edges 411, 421, 431. Each fixed edge 411, 421, 431 is associated with a respective one of the curved vanes 41, 42, 43. The fixed edges 411, 421, 431 are fixed to the circumferential inner surface 21 of the tubular rotating member 2.

The plurality of curved vanes 41, 42, 43 also include a plurality of free edges 412, 422, 432. Each free edge 412, 422, 432 is associated with a respective one of the curved vanes 41, 42, 43. Free edges 412, 422, 432 are spaced apart from the circumferential inner surface 21 of tubular rotating member 2. The plurality of free edges 412, 422, 432 defines a central open space 50, as shown in FIG. 3.

The plurality of curved vanes 41, 42, 43 also include a plurality of associated inlet side edges 413, 423, 433. Each of the inlet side edges 413, 423, 433 is associated with a respective one of the curved vanes 41, 42, 43. Each of the inlet side edges 413, 423, 433 is disposed proximate to the inlet opening 22 and extends between a respective one of the fixed edges 411, 421, 431 and a respective one of the free edges 412, 422, 432.

The plurality of curved vanes 41, 42, 43 also includes a plurality of outlet side edges 414, 424, 434. Each of the outlet side edges 414, 424, 434 is associated with a respective one of the curved vanes 41, 42, 43. Each of the outlet side edges 414, 424, 434 is disposed distal to the inlet opening 22 and extends between a respective one of the fixed edges 411, 421, 431 and a respective one of the free edges 412, 422, 432.

Each of the curved vanes 41, 42, 43 is spaced apart from each adjacent curved vane to define a plurality of curved radial openings 401, 402, 403 between adjacent curved vanes. Each of the plurality of curved radial openings 401, 402, 403 adjoins the central open space 50 to form a continuous open path, as shown in FIG. 3.

FIG. 5 shows an exploded perspective view of a hair dryer assembly, according to another embodiment of the invention. In the embodiment shown in FIG. 5, a rotating air directing apparatus is integrated with the barrel 110 of the hair dryer 100. The components and arrangement thereof may be as previously described for the embodiment shown in FIGS. 1-4, except that the tubular adapter member 1 is not required. Accordingly, the tubular rotating member 2 is rotatably coupled to the barrel 110 of the hair dryer 100, rather than to the tubular adapter member 1.

Figure 6:
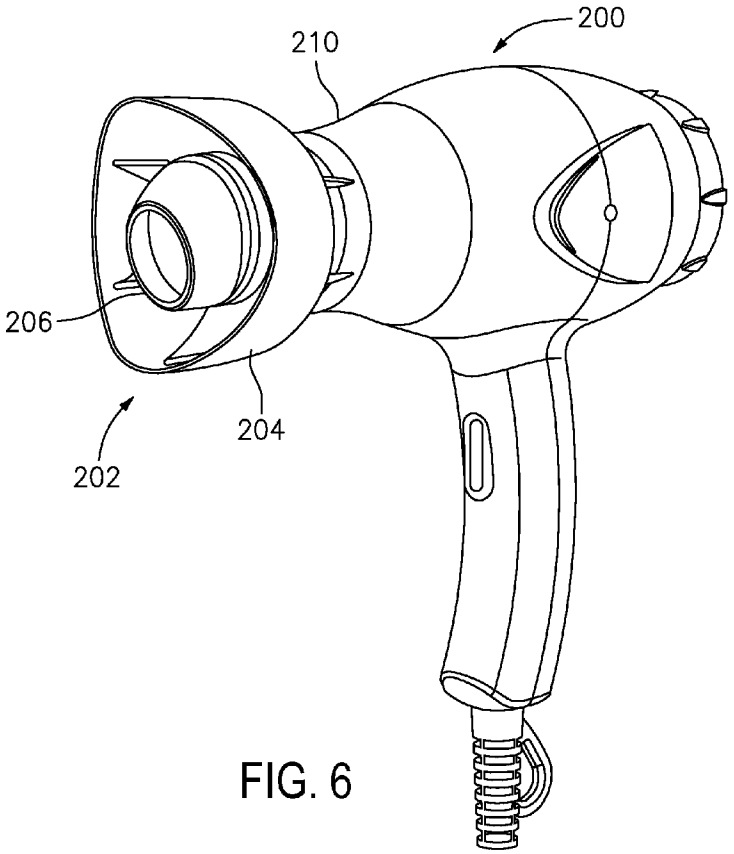
FIG. 6 is a diagram illustrating a perspective view of a rotating air directing apparatus attached to a hair dryer, according to another embodiment of the present invention.

FIG. 6 is a diagram illustrating a perspective view of a rotating air directing apparatus attached to a hair dryer, according to an additional embodiment of the present invention. A rotating air directing apparatus 202 is attached to a barrel 210 of a hair dryer 200. The apparatus 202 includes an adapter member 204 that houses the elements of the apparatus 202, and connects the apparatus 202 to the barrel 210 of the hair dryer 200. The apparatus 202 may be connected to the hair dryer 200 in any one of the ways described above with respect to FIGS. 1-4. The apparatus also includes a nozzle member 206 that extends out from a center of the adapter member 204 at a side of the adapter member 204 that is opposite that of the connection to the barrel 210. The nozzle member 206 is rotatably connected to components disposed in an interior of the adapter member 204, and rotates independent of the adapter member 204.

Figure 7:
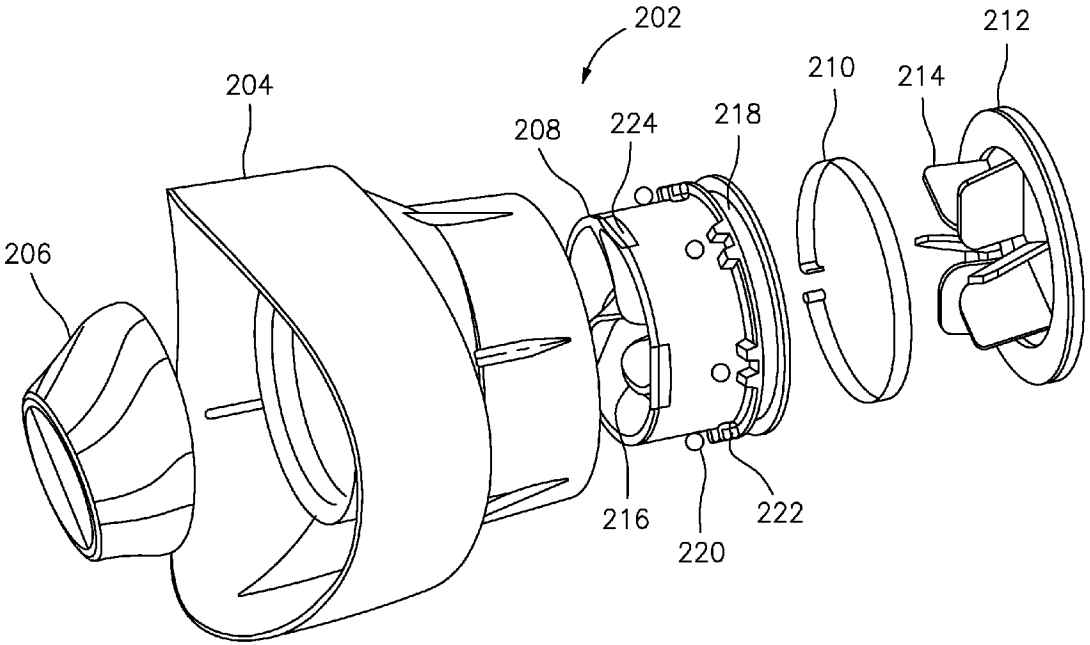
FIG. 7 is a diagram illustrating an exploded perspective view of the apparatus, according to the embodiment of the present invention illustrated in FIG. 6.

Referring now to FIG. 7, a diagram illustrates an exploded view of the apparatus, according to the embodiment of the present invention illustrated in FIG. 6. The apparatus 202 is shown having the adapter member 204, the nozzle member 206, a tubular rotating member 208, a speed reducing element 210, and an air directing member 212. The tubular rotating member 208, the speed reducing element 210, and the air directing member 212 are each disposed within the adapter member 204. The air directing member 212 is disposed in a fixed position within the adapter member, and has a plurality of vanes 214 that direct air received from the hair dryer 200. Specifically, an edge of each of the vanes 214 extends radially out from a central point of the air directing member 212 to a circumference of the air directing member 212. Each vane is tilted/slanted at a specified acute angle from a corresponding plane perpendicular to the circumference of the air directing member 212. The tubular rotating member 208 freely rotates within the adapter member 204 when air directed from the vanes 214 of the air directing member 212 impacts internal curved vanes 216 of the tubular rotating member 208. The curved vanes 216 of the tubular rotating member 208 are similar to those illustrated and described in the tubular rotating member 2 of FIGS. 1-5. While FIGS. 1-5 illustrate vanes having defined free edges and side edges, the free edges may also extend in a curved manner to a fixed edge on the internal circumference of the tubular rotating member 208 without a clear transition between free edges and side edges.

The speed reducing element 210 is disposed within a groove 218 of the tubular rotating member 208, and assists in reducing the speed at which the tubular rotating member 208 rotates within the adapter member 204. The speed reducing element 210 reduces a rotating speed of the tubular rotating element 208 by expanding beyond the circumference of the tubular rotating member 208 due to centrifugal force when the tubular rotating member 208 is rotating causing contact and friction between the speed reducing element 210 and an interior circumference of the tubular adapter member 204.

The tubular rotating member 208 also includes ball bearings 220 that are disposed within ball retainers 222 on an external circumference of the tubular rotating member 208. The ball bearings 220 contact an internal ledge and the internal circumferential wall of the adapter member 204 when fully assembled. These contact points allow the tubular rotating member 208 to rotate freely within the adapter member 204 while preventing the tubular rotating member 208 from being able to slip out an end of the adapter member 204 from where the nozzle member 206 extends. The tubular rotating member 208 also includes a plurality of receiving elements 224 on an end of its outer circumference near the nozzle member 206 to assist in the attachment between the nozzle member 206 and the tubular rotating member 208. An interior circumference of the nozzle member 206 may have a plurality of protruding elements that fit into the receiving elements 224 to assist in the attachment to the tubular rotating member 208.

Figure 8:
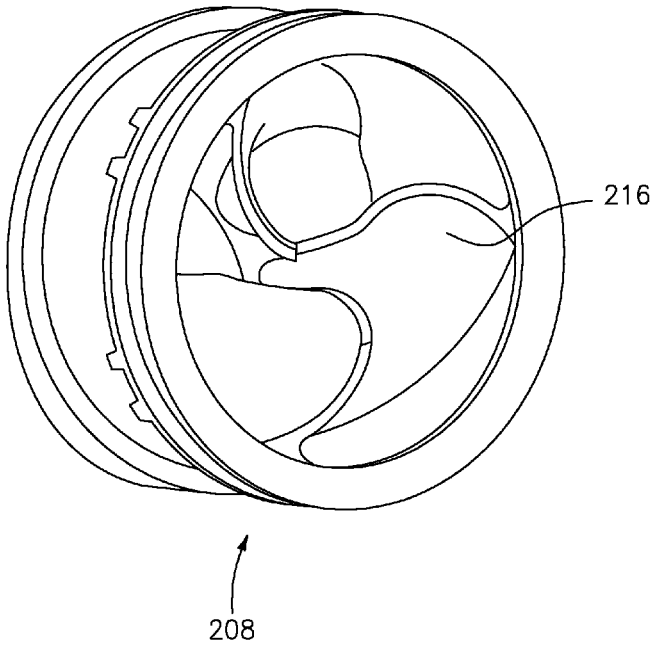
FIG. 8 is a diagram illustrating a perspective view of a tubular rotating member in the apparatus, according to the embodiment of the present invention illustrated in FIG. 6.

Referring now to FIG. 8, a diagram illustrates a perspective view of the tubular rotating member 208, according to the embodiment of the present invention illustrated in FIG. 6. This perspective view clearly shows an interior of the tubular rotating member 208, in which the three curved vanes 216 are illustrated, and are shown as similar to those illustrated and described with respect to FIGS. 1-5.

Figure 9A:
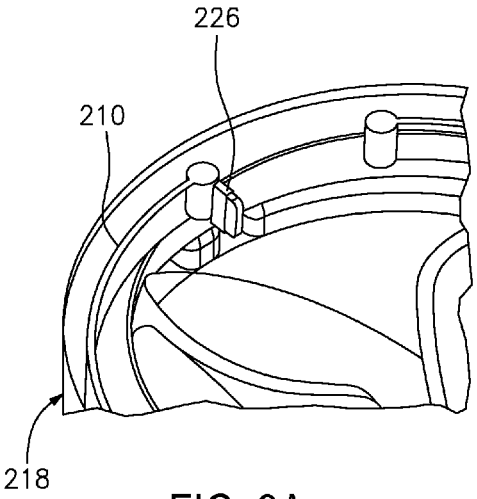
FIG. 9A is a diagram illustrating a partial perspective view of first connection type of a speed reducing element to the tubular rotating member, according to the embodiment of the present invention illustrated in FIG. 6.
Figure 9B:
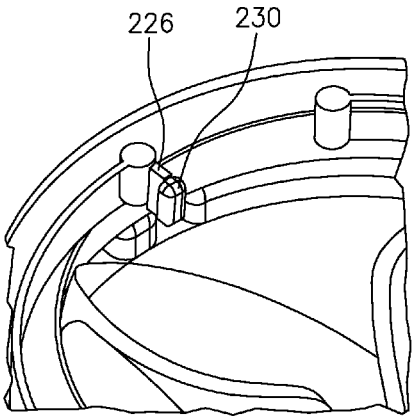
FIG. 9B is a diagram illustrating a partial perspective view of a second connection type of a speed reducing element to the tubular rotating member, according to the embodiment of the present invention illustrated in FIG. 6.
Figure 9C:
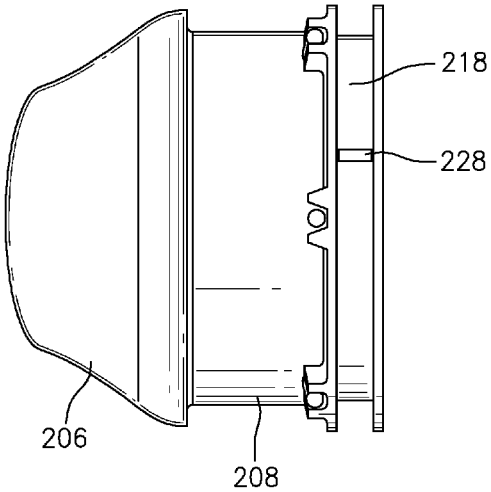
FIG. 9C is a diagram illustrating a side view of the tubular rotating member and the nozzle member, according to the embodiment of the present invention illustrated in FIG. 6.

Referring now to FIG. 9A, a diagram illustrates a partial perspective view of a first connection of the speed reducing element 210 to the tubular rotating member 208, according to the embodiment of the present invention illustrated in FIG. 6. The speed reducing element 210 sits within the groove 218 and includes a tab 226 that extends into an aperture 228 within the groove 218 of the tubular rotating member 208. The tab 226 holds the speed reducing element 210 in place within the groove while the tubular rotating member 208 rotates. The diagram of FIG. 9B illustrates a second connection, in which the tab 226 has been ultra-sonically welded on the interior of the tubular rotating member 208. The speed reducing element 210 is locked in the groove 218 because a head 230 of the tab 226 is formed when the plastic is melted during ultra-sonic welding, and the head 230 is larger than the aperture 228. FIG. 9C illustrates a side view of the rotating tubular member 208 and the attached nozzle member 206, according to an embodiment of the present invention. The aperture 228 is shown within the groove 218, where the speed reducing element 210 is to be disposed.

Figure 10:
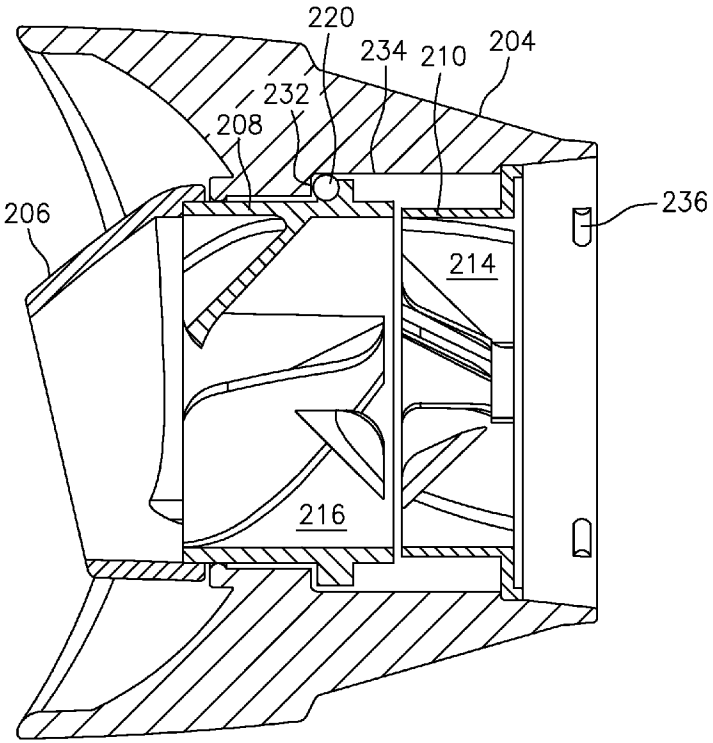
FIG. 10 is a diagram illustrating a cross-sectional view of the assembled apparatus, according to the embodiment of the present invention illustrated in FIG. 6.

FIG. 10 is a diagram illustrating a cross-sectional view of the assembled apparatus, according to the embodiment of the present invention illustrated in FIG. 6. The adapter member 204 is shown housing the nozzle member 206, the rotating tubular member 208 and the air directing member 210. The air directing member 210 is fixedly disposed within the adapter member 204, while the rotating tubular member 208 and the nozzle member 206 are rotatably disposed within the adapter member 204. A gap is disposed between the air directing member 210 and the rotating tubular member 208, so that the rotating tubular member 208 may rotate freely without contacting the air directing member 208. Air is directed by the vanes 214 of the air directing member 210 to the curved vanes 216 of the rotating tubular member 208 causing the rotating tubular member 208 to rotate within the adapter member 204. The nozzle member 206 rotates with the rotating tubular member 208 due to its connection with the rotating tubular member 208 at the receiving elements 224. Specifically, the nozzle member 206 is connected to the rotating tubular member 208 via ultra-sonic welding. The rotating tubular member 208 rotates freely because the rotating tubular member 208 contacts the adapter member 204 with the ball bearings 220 at an internal edge 232 and an internal circumferential wall 234 of the adapter member 204. The internal circumference of the adapter member 204 also includes protruding elements 236 that are disposed near an end of the adapter member 204 opposite that of the nozzle member 206. The protruding elements 236 assist in detachably connecting the adapter member 204 to the barrel 210 of the hair dryer 200.

Figure 11A:
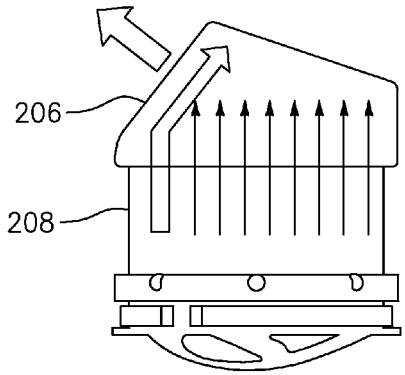
FIG. 11A is a diagram illustrating a side view of the tubular rotating member and the nozzle member, according to the embodiment of the present invention illustrated in FIG. 6.

Referring now to FIG. 11A, a diagram illustrates a side view of the tubular rotating member 208 and the nozzle member 206, according to the embodiment of the present invention illustrated in FIG. 6. The nozzle member 206 is shown having an acutely angled opening that extends only partially across a planar circumference of the nozzle member 206. Specifically, the opening of the nozzle member 206 extends from a first end of the planar circumference outwardly at an acute angle to a point beyond the center of the planar circumference of the nozzle member 206 but not reaching the other end of the planar circumference. The opening is preferably ovular in shape.

Figure 11B:
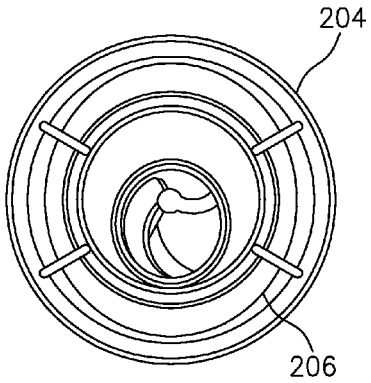
FIG. 11B is a diagram illustrating a front view of the assembled apparatus, according to the embodiment of the present invention illustrated in FIG. 6.
Figure 11C:
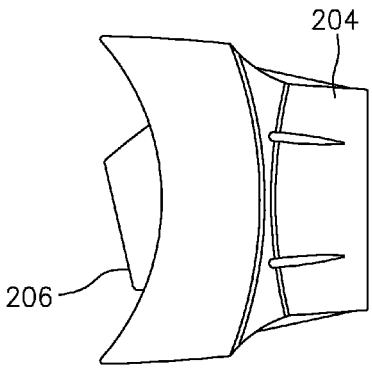
FIG. 11C is a diagram illustrating a side view of the assembled apparatus, according to the embodiment of the present invention illustrated in FIG. 6.

FIGS. 11B and 11C illustrate a front and side view of the adapter member 204 and the nozzle member 206, according to an embodiment of the present invention. A center line C/L is drawn through a center of the adapter member 204. In an embodiment of the present invention a highest point of the opening of the nozzle member 206 is illustrated as 7.3 mm above the center line C/L, while a center line of the opening of the nozzle member 206 is illustrated as 6.3 mm below the center line C/L.

Figure 12A:
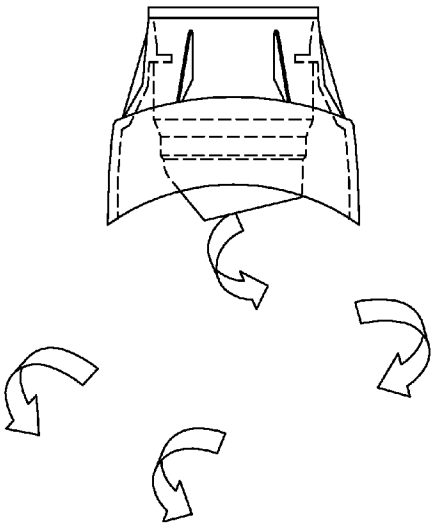
FIG. 12A is a diagram illustrating a side view of air movement exiting the nozzle member, according to the embodiment of the present invention illustrated in FIG. 6.
Figure 12B:
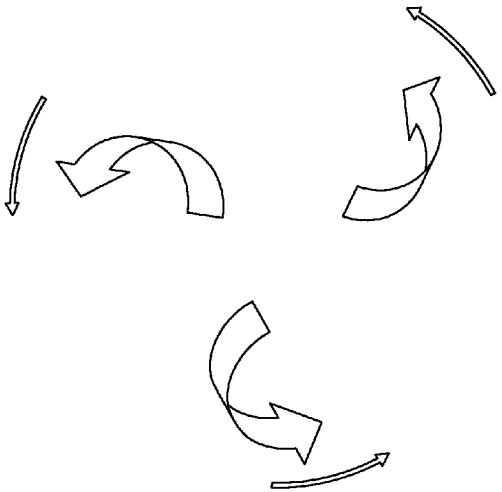
FIG. 12B is a diagram illustrating a front view of air movement exiting the nozzle member, according to the embodiment of the present invention illustrated in FIG. 6.

FIGS. 12A and 12B illustrate the air flow from the apparatus, according to the embodiment of the present invention illustrated in FIG. 6. FIG. 12A illustrates a side view and FIG. 12B illustrates a front view of the air flow that results when the nozzle rotates and the air released from the nozzle is rotating. Specifically, the air flow exiting the nozzle is circularly rotating and a direction that the circularly rotating air is output is constantly changed in a circular manner in accordance with the rotating nozzle. This causes a tornado effect that is more effective in drying hair.

The embodiment of the present invention illustrated in FIGS. 6-12B can also be adapted such that it is part of a hair dryer assembly. This adaptation would involve the use of the barrel of the hairdryer instead of a tubular adapter, as shown in FIG. 5.

Figure 13:
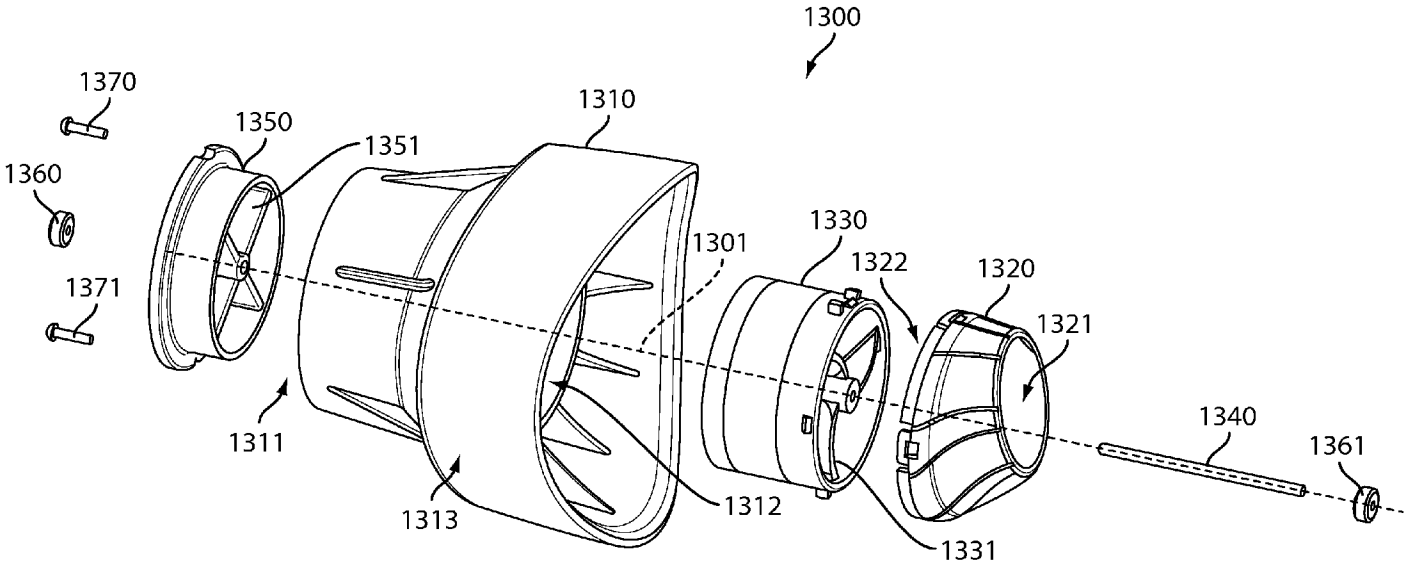
FIGS. 13-16 each depict an exploded perspective view of a hair dryer attachment according to an embodiment of the present invention.

Referring now to FIG. 13, the diagram illustrates an exploded view of a hair dryer attachment 1300 according to an embodiment of the present invention. In the illustrated embodiment, the attachment 1300 includes a tubular adapter (or "attachment body") 1310, nozzle 1320, tubular rotating member 1330 (or "fan"), shaft 1340, and air directing member 1350.

In the illustrated embodiment, the tubular adapter member 1310 is configured to reduce a temperature of an outer portion 1313 of the attachment body 1310. The illustrated tubular adapter 1310 includes an inlet opening 1311, outlet opening 1312, and outer portion 1311. The inlet opening 1310 of the adapter member 1310 is adapted to be removably coupled to a barrel of a hair dryer. The tubular adapter member 1310 can further be configured to concentrate an airflow generated by the attached hairdryer.

The illustrated nozzle 1320 controls a direction and a speed of the airflow. For example, the nozzle 1320 can cause a pulsating airflow by rotating at approximately 1500 to 2500 RPM. In the illustrated embodiment, the nozzle 1320 can be configured to produce a toroidal-shaped airflow from the outlet opening 1321. The inlet end 1322 of the nozzle 1320 is disposed adjacent to the outlet opening 1312 of the tubular adapter 1310 and is adapted to rotate independent of the tubular adapter member 1330, although in other embodiments they can rotate together. The nozzle 1320 may be rigidly coupled to the tubular rotating member 1330 or may be formed integrally therewith to provide a single unitary structure. The nozzle 1320 includes an angled tubular member, which can have, for example, a semi-conical or frusto-conical shape.

The outlet end 1321 of the nozzle 1320 is disposed at an acute angle relative to the distal outlet opening 1312 of the tubular adapter member 1310. Specifically, an imaginary perpendicular line passing through a center of the outlet end 1321 of the nozzle 1320 forms an angle of less than ninety degrees with an imaginary perpendicular line 1301 passing though a center of the distal outlet opening 1312. Due to the configuration of the angled nozzle opening, when the nozzle member 1320 rotates, a moving, rotating pattern of heated air flow is created which is similar to that achieved by an operator manually manipulating the hair dryer relative to the hair to be dried. The nozzle 1320 may be formed from a rigid, lightweight plastic material or any other suitable material or materials.

The tubular rotating member 1330, and the air directing member 1350 are each disposed within the tubular adapter member 1310. The air directing member 1350 is disposed in a fixed position within the adapter member 1310, and has one or more vanes 1351 that direct air received from the hair dryer. The air directing member 1350 is disposed adjacent to the inlet opening 1311 of the adapter member 1310, and is affixed to the tubular adapter member 1310 with screws 1370, 1371.

In some embodiments, an edge of each of the vanes 1351 extends radially out from a central point of the air directing member 1350 to a circumference of the air directing member 1350. Each vane is tilted/slanted at a specified acute angle from a corresponding plane perpendicular to the circumference of the air directing member 1350.

The tubular rotating member 1330 freely rotates within the adapter member 1310 when air directed from the vanes 1351 of the air directing member 1350 impacts internal curved vanes 1331 of the tubular rotating member 1330. In the illustrated embodiment, the member 1330 can have one, two, three or more vanes 1331, curved or otherwise. The vanes 1331 of the tubular rotating member 1330 are similar to those illustrated and described in the tubular rotating member of FIGS. 1-5. While FIGS. 1-5 illustrate vanes having defined free edges and side edges, the free edges may also extend in a curved manner to a fixed edge on the internal circumference of the tubular rotating member 1330 without a clear transition between free edges and side edges.

In this illustrated embodiment, the tubular rotating member 1330 snap fits to the nozzle 1320 and rotates the nozzle 1320 with a controlled RPM (e.g., between 1500 and 2500 RPM), although in other embodiments, it can be configured otherwise. Moreover, an outer portion of the tubular rotating member 1330 can prevent, or reduce, heat transfer from the airflow to the other components of the attachment 1300.

The illustrated shaft 1340 is configured to extend within the tubular rotating member 1330 and is affixed to the air directing member 1350 with nuts 1360, 1361, although in other embodiments, it may be configured otherwise. In the illustrated embodiment, more particularly, the nuts 1360, 1361 comprise oilless bushings, although in other embodiments they can be washers or other types of nuts.

Figure 14:
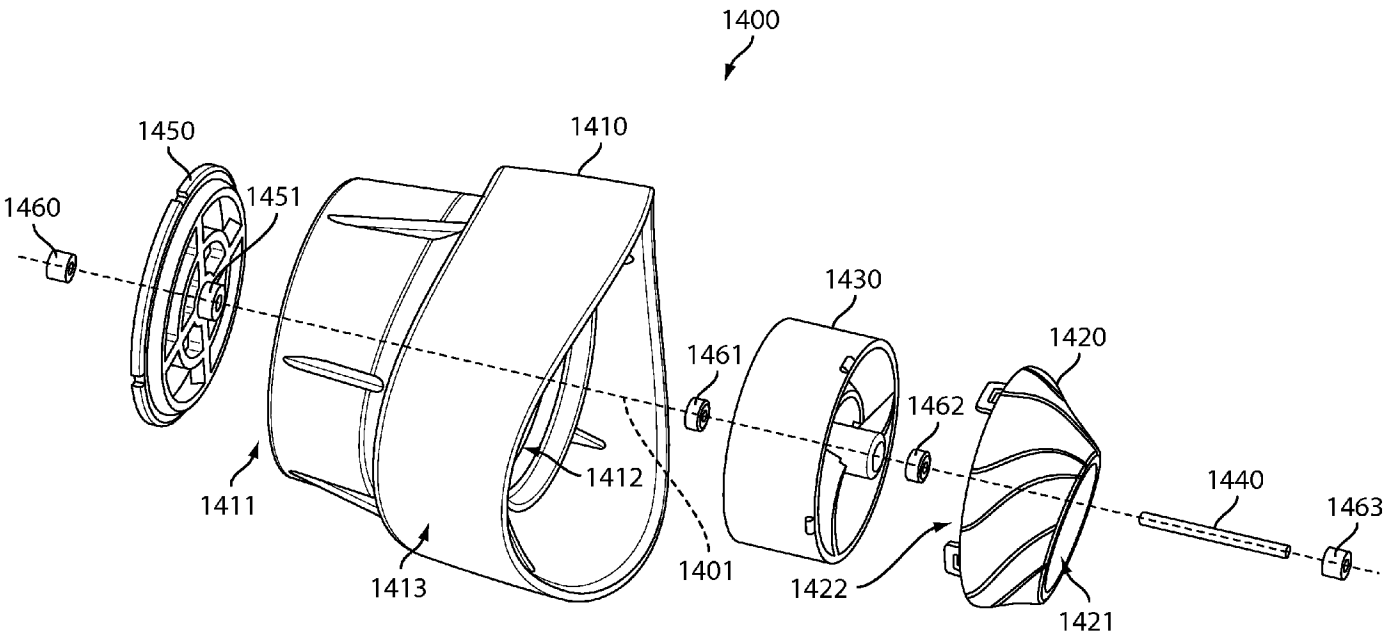

Referring now to FIG. 14, a diagram illustrates an exploded view of a hair dryer attachment 1400 according to an embodiment of the present invention. In the illustrated embodiment, the attachment 1400 includes a tubular adapter (or "attachment body") 1410, nozzle 1420, tubular rotating member 1430 (or "fan"), shaft 1440, and axis holder 1450.

In the illustrated embodiment, the tubular adapter member 1410 is configured to reduce a temperature of an outer portion 1413 of the attachment body 1410. The illustrated tubular adapter 1410 includes an inlet opening 1411, outlet opening 1412, and outer portion 1411. The inlet opening 1410 of the adapter member 1410 is adapted to be removably coupled to a barrel of a hair dryer. The tubular adapter member 1410 can further be configured to concentrate an airflow generated by the attached hairdryer.

The illustrated nozzle 1420 controls the direction and speed of the airflow. For example, the nozzle 1420 can cause a pulsating airflow by rotating at approximately 1500 to 2500 RPM. In the illustrated embodiment, the nozzle 1420 can be configured to produce a toroidal-shaped airflow from the outlet opening 1421. The inlet end 1422 of the nozzle 1420 is disposed adjacent to the outlet opening 1412 of the tubular adapter 1410 and is adapted to rotate independent of the tubular adapter member 1430. The nozzle 1420 may be rigidly coupled to the tubular rotating member 1430 or may be formed integrally therewith to provide a single unitary structure. The nozzle 1420 includes an angled tubular member, which can have, for example, a semi-conical or frusto-conical shape.

The outlet end 1421 of the nozzle 1420 is disposed at an acute angle relative to the distal outlet opening 1412 of the tubular adapter member 1410. Specifically, an imaginary perpendicular line passing through a center of the outlet end 1421 of the nozzle 1420 forms an angle of less than ninety degrees with an imaginary perpendicular line 1301 passing though a center of the distal outlet opening 1412. Due to the configuration of the angled nozzle opening, when the nozzle member 1420 rotates, a moving, rotating pattern of heated air flow is created which is similar to that achieved by an operator manually manipulating the hair dryer relative to the hair to be dried. The nozzle 1420 may be formed from a rigid, lightweight plastic material or any other suitable material or materials.

The tubular rotating member 1430, and the axis holder 1450 are each disposed within the tubular adapter member 1410. The axis holder 1450 is comprises a rotating axis that connects the rotating and non-rotating components of the attachment 1400.

The tubular rotating member 1430 freely rotates within the adapter member 1410 when the airflow impacts internal curved vanes 1431 of the tubular rotating member 1430. In the illustrated embodiment, the member 1430 can have one, two, three or more vanes 1431, curved or otherwise. The vanes 1431 of the tubular rotating member 1430 are similar to those illustrated and described in the tubular rotating member 2 of FIGS. 1-5. While FIGS. 1-5 illustrate vanes having defined free edges and side edges, the free edges may also extend in a curved manner to a fixed edge on the internal circumference of the tubular rotating member 1430 without a clear transition between free edges and side edges.

In this illustrated embodiment, the tubular rotating member 1430 can snap fit to the nozzle 1420 and rotate the nozzle 1420 with a controlled RPM (e.g., between 1500 and 2500 RPM), although in other embodiments, it can be configured otherwise. Moreover, an outer portion of the tubular rotating member 1430 can prevent, or reduce, heat transfer from the airflow to the other components of the attachment 1400.

The illustrated shaft 1440 is configured to extend within the tubular rotating member 1430 and is affixed to the axis holder 1450 with nuts 1460-1463, although in other embodiments, it may be configured otherwise. In the illustrated embodiment, more particularly, the nuts 1460, 1461 comprise oilless bushings, although in other embodiments they can be washers or other types of nuts.

Figure 15:
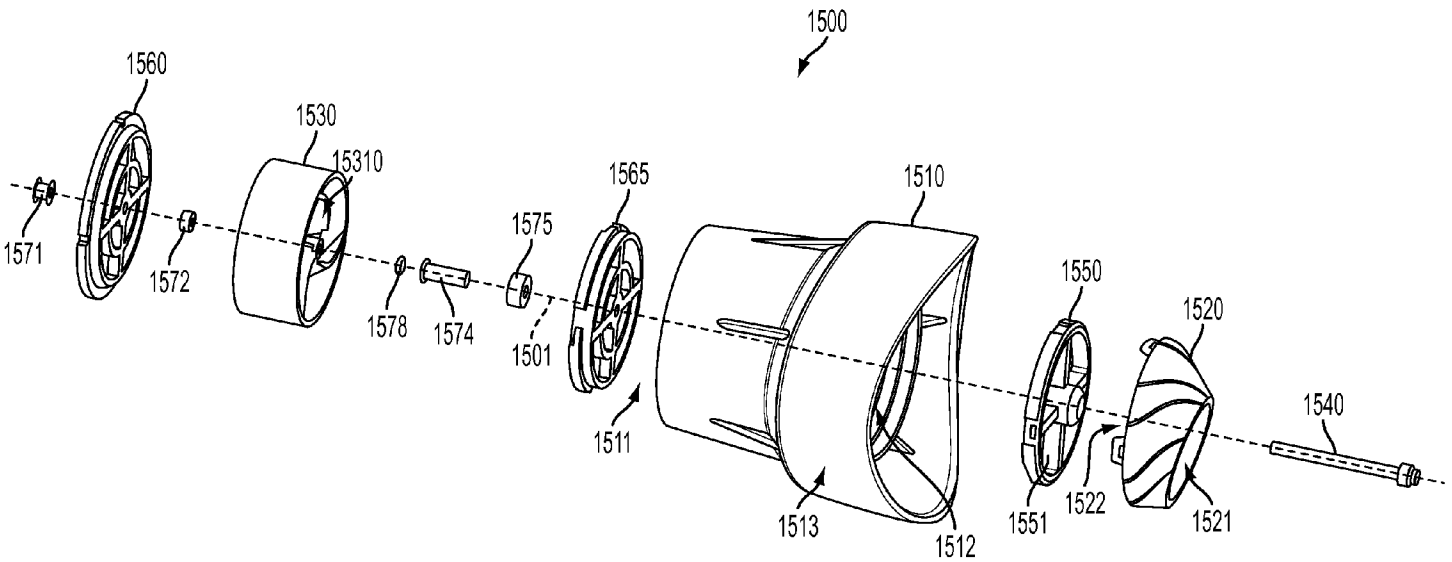

Referring now to FIG. 15, a diagram illustrates an exploded view of a hair dryer attachment 1500 according to an embodiment of the present invention. In the illustrated embodiment, the attachment 1500 includes a tubular adapter (or "attachment body") 1510, nozzle 1520, tubular rotating member 1530 (or "fan"), shaft 1540, stopper 1550 and axis holders 1560, 1565.

In the illustrated embodiment, the tubular adapter member 1510 is configured to reduce a temperature of an outer portion 1513 of the attachment body 1510. The illustrated tubular adapter 1510 includes an inlet opening 1511, outlet opening 1512, and outer portion 1511. The inlet opening 1510 of the adapter member 1510 is adapted to be removably coupled to a barrel of a hair dryer. The tubular adapter member 1510 can further be configured to concentrate an airflow generated by the attached hairdryer.

The illustrated nozzle 1520 controls a direction and speed of the airflow. For example, the nozzle 1520 can cause a pulsating airflow by rotating at approximately 1500 to 2500 RPM. In the illustrated embodiment, the nozzle 1520 can be configured to produce a toroidal-shaped airflow from the outlet opening 1521. The inlet end 1522 of the nozzle 1520 is disposed adjacent to the outlet opening 1512 of the tubular adapter 1510 and is adapted to rotate independent of the tubular adapter member 1530. The nozzle 1520 may be rigidly coupled to the tubular rotating member 1530 or may be formed integrally therewith to provide a single unitary structure. The nozzle 1520 includes an angled tubular member, which can have, for example, a semi-conical or frusto-conical shape.

The outlet end 1521 of the nozzle 1520 is disposed at an acute angle relative to the distal outlet opening 1512 of the tubular adapter member 1510. Specifically, an imaginary perpendicular line passing through a center of the outlet end 1521 of the nozzle 1520 forms an angle of less than ninety degrees with an imaginary perpendicular line 1501 passing though a center of the distal outlet opening 1512. Due to the configuration of the angled nozzle opening, when the nozzle member 1520 rotates, a moving, rotating pattern of heated air flow is created which is similar to that achieved by an operator manually manipulating the hair dryer relative to the hair to be dried. The nozzle 1520 may be formed from a rigid, lightweight plastic material or any other suitable material or materials.

The tubular rotating member 1530 and the axis holders 1560, 1565 are each disposed within the tubular adapter member 1510. The axis holders 1560, 1565 comprise rotating axis' that connect the rotating and non-rotating components of the attachment 1500.

The tubular rotating member 1530 freely rotates within the adapter member 1510 when the airflow impacts internal curved vanes 1531 of the tubular rotating member 1530. In the illustrated embodiment, the member 1530 can have one, two, three or more vanes 1531, curved or otherwise. The vanes 1531 of the tubular rotating member 1530 are similar to those illustrated and described in the tubular rotating member of FIGS. 1-5. While FIGS. 1-5 illustrate vanes having defined free edges and side edges, the free edges may also extend in a curved manner to a fixed edge on the internal circumference of the tubular rotating member 1530 without a clear transition between free edges and side edges.

In this illustrated embodiment, an outer portion of the tubular rotating member 1530 can prevent, or reduce, heat transfer from the airflow to the other components of the attachment 1400.

The illustrated stopper 1550 supports the shaft 1540. The stopper includes two or more support members 1551 that maintain a central aperture in a central region of the stopper 1550. The shaft 1540 extends from the central aperture of the stopper 1550.

The illustrated shaft 1540 is configured to extend within the tubular rotating member 1530 and is affixed to the axis holders 1560, 1565 with nuts and screws 1570-1575, although in other embodiments, it may be configured otherwise.

Figure 16:
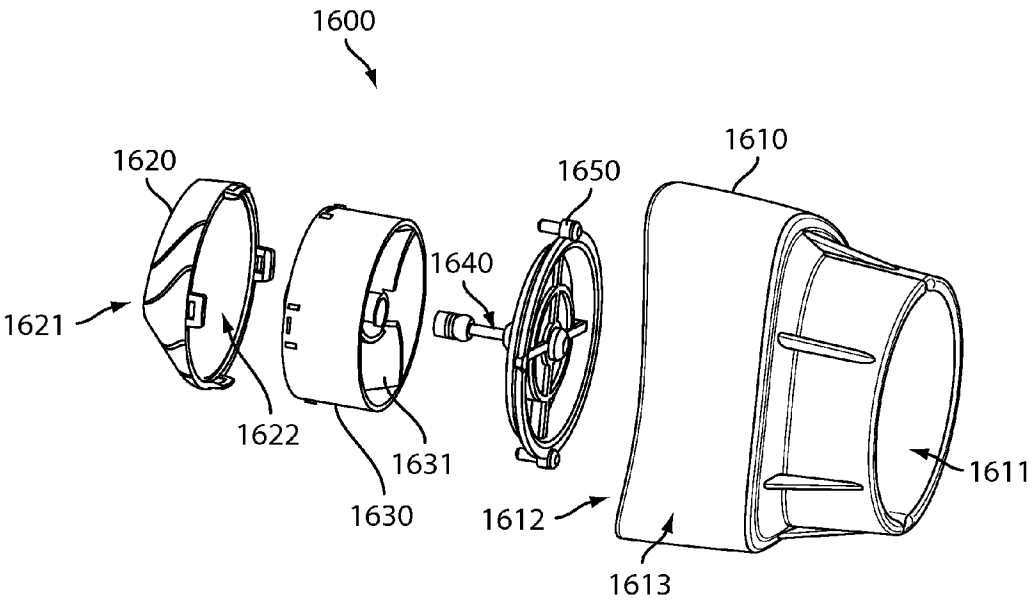

Referring now to FIG. 16, a diagram illustrates an exploded view of a hair dryer attachment 1600 according to an embodiment of the present invention. In the illustrated embodiment, the attachment 1600 includes a tubular adapter (or "attachment body") 1610, nozzle 1620, tubular rotating member 1630 (or "fan"), and axis holder 1650.

In the illustrated embodiment, the tubular adapter member 1610 is configured to reduce a temperature of an outer portion 1613 of the attachment body 1610. The illustrated tubular adapter 1610 includes an inlet opening 1611, outlet opening 1612, and outer portion 1611. The inlet opening 1610 of the adapter member 1610 is adapted to be removably coupled to a barrel of a hair dryer. The tubular adapter member 1610 can further be configured to concentrate an airflow generated by the attached hairdryer.

The illustrated nozzle 1620 controls a direction and speed of the airflow. For example, the nozzle 1620 can cause a pulsating airflow by rotating at approximately 1500 to 2500 RPM. In the illustrated embodiment, the nozzle 1620 can be configured to produce a toroidal-shaped airflow from the outlet opening 1621. The inlet end 1622 of the nozzle 1620 is disposed adjacent to the outlet opening 1612 of the tubular adapter 1610 and is adapted to rotate independent of the tubular adapter member 1630. The nozzle 1620 may be rigidly coupled to the tubular rotating member 1630 or may be formed integrally therewith to provide a single unitary structure. The nozzle 1620 includes an angled tubular member, which can have, for example, a semi-conical or frusto-conical shape.

The outlet end 1621 of the nozzle 1620 is disposed at an acute angle relative to the distal outlet opening 1312 of the tubular adapter member 1610. Specifically, an imaginary perpendicular line passing through a center of the outlet end 1621 of the nozzle 1620 forms an angle of less than ninety degrees with an imaginary perpendicular line passing though a center of the distal outlet opening 1612. Due to the configuration of the angled nozzle opening, when the nozzle member 1620 rotates, a moving, rotating pattern of heated air flow is created which is similar to that achieved by an operator manually manipulating the hair dryer relative to the hair to be dried. The nozzle 1620 may be formed from a rigid, lightweight plastic material or any other suitable material or materials.

The tubular rotating member 1630, and the axis holder 1650 are each disposed within the tubular adapter member 1610. The axis holder 1650 is comprises a rotating axis that connects the rotating and non-rotating components of the attachment 1600.

The tubular rotating member 1630 freely rotates within the adapter member 1610 when air directed from the attachment 1310 impacts internal curved vanes 1631 of the tubular rotating member 1630. In the illustrated embodiment, the member 1630 can have one, two, three or more vanes 1631, curved or otherwise. The vanes 1631 of the tubular rotating member 1630 are similar to those illustrated and described in the tubular rotating member of FIGS. 1-5. While FIGS. 1-5 illustrate vanes having defined free edges and side edges, the free edges may also extend in a curved manner to a fixed edge on the internal circumference of the tubular rotating member 1630 without a clear transition between free edges and side edges.

In this illustrated embodiment, the tubular rotating member 1630 snap fits to the nozzle 1620 and rotates the nozzle 1320 with a controlled RPM (e.g., between 1500 and 2500 RPM), although in other embodiments, it can be configured otherwise. Moreover, an outer portion of the tubular rotating member 1330 can prevent, or reduce, heat transfer from the airflow to other components of the attachment 1300.

While the invention has been shown and described with reference to certain embodiments thereof, it will be understood by those skilled in the art that various changes in form and detail may be made therein without departing from the spirit and scope of the invention as defined by the appended claims.

What is claimed is:

1. A rotating airflow directing apparatus integral to a barrel of a hair dryer, the apparatus comprising:

A) a tubular rotating member rotatably coupled and disposed internal to the barrel of the hair dryer, wherein the tubular rotating member comprises an inlet opening, an outlet opening, and a plurality of curved vanes disposed and housed within the barrel; and B) an angular frusto-conical nozzle having an oblique conical shape coupled to, or formed integrally with, the outlet opening of the tubular rotating member.

2. The apparatus of claim 1, wherein the nozzle includes an outlet opening having an ovular shape.

3. A rotating air directing apparatus for a barrel of a hair dryer, the apparatus comprising:

a tubular adapter member adapted to be removably coupled to the barrel of the hair dryer;

a tubular rotating member that is dimensioned to fit inside, and is housed within the tubular adapter member, the tubular rotating member being rotatably coupled to the tubular adapter member by one or more bearing elements that position the tubular rotating member substantially centrally within the tubular adapter member, wherein the tubular rotating member comprises a circumferential inner surface, an inlet opening, an outlet opening, and a plurality of curved vanes; and an angular frusto-conical nozzle member having an oblique conical shape and adapted to rotate with the tubular rotating member, wherein the nozzle member comprises an angled tubular member having a nozzle inlet opening disposed adjacent to the outlet opening of the tubular rotating member and a nozzle outlet opening disposed at an acute angle relative to the outlet opening of the tubular rotating member, wherein the plurality of curved vanes each have a fixed edge at the circumferential inner surface that extends from the inlet opening to the outlet opening of the tubular rotating member; and wherein each of the plurality of curved vanes are spaced apart from each other, thereby defining a plurality of curved radial openings between adjacent curved vanes.

4. The rotating air directing apparatus according to claim 3, wherein the at least one bearing element comprises a first bearing element proximate to the outlet opening and a second bearing element proximate to the inlet opening.

5. The rotating air directing apparatus according to claim 3, wherein the plurality of curved vanes are integrally formed with the tubular rotating member.

6. The rotating air directing apparatus according to claim 3, wherein the plurality of curved vanes comprises a first curved vane, a second curved vane and a third curved vane.

7. The rotating air directing apparatus according to claim 3, wherein each of the plurality of curved vanes comprises one or more side edges extending between the fixed edge and the free edge.

8. The rotating air directing apparatus according to claim 3, wherein the opposing free edge of each of the plurality of curved vanes is curved so that it contacts both ends of its corresponding fixed edge.

9. The rotating air directing apparatus according to claim 3, wherein the tubular rotating member comprises a plurality of ball bearings in respective ball bearing retainers on a circumferential outer surface of the tubular rotating member.

10. The rotating air directing apparatus according to claim 9, wherein the plurality of ball bearings provide contact between the tubular rotating member and the tubular adapter member at an inner ledge and a circumferential inner surface of the tubular adapter member.

11. The rotating air directing apparatus according to claim 3, further comprising an air directing member fixedly disposed within the tubular adapter member adjacent to the inlet opening of the tubular rotating member.

12. The rotating air directing apparatus according to claim 11, wherein the air directing member comprises a plurality of vanes that each extend radially from a center of the air directing member to a circumference of the air directing member, and are individually slanted to change the direction of air flow.

13. The rotating air directing apparatus according to claim 12, wherein the plurality of vanes are slanted at an acute angle from a corresponding plane that is perpendicular to the circumference of the air directing member.

14. A rotating airflow directing attachment for a barrel of a hair dryer, the attachment comprising:

A) a tubular adapter having an inlet opening and an outlet opening, wherein the inlet opening is adapted to be removably coupled to the barrel of the hair dryer;

B) one or more vanes rotatably coupled to, and housed within, the tubular adapter; and C) an angular frusto-conical nozzle having an oblique conical shape disposed adjacent to the outlet opening of the tubular adapter and adapted to rotate with the one or more vanes, wherein the nozzle has an outlet opening disposed at an acute angle relative to the outlet opening of the tubular adapter.

15. The attachment of claim 14, wherein at least one of the one or more vanes is curved.

16. The attachment of claim 14, wherein the nozzle outlet opening is ovular.

17. The attachment of claim 14, wherein the nozzle is either (i) rigidly coupled to the tubular adapter, or (ii) integrally formed with the tubular adapter in a single unitary structure.

18. The attachment of claim 14, wherein the tubular adapter is configured to reduce a temperature of the attachment.

19. The attachment of claim 14, wherein the nozzle outlet opening is disposed such that a perpendicular line passing through a center of the nozzle outlet opening forms an angle of less than ninety degrees with a perpendicular line passing through a center of the outlet opening of the tubular adapter.

20. The attachment of claim 14, wherein the nozzle is configured to produce, through the outlet opening of the nozzle, a moving, rotating pattern of heated air flow comparable to that achieved when an operator manually manipulates the hair dryer relative to hair to be dried.

21. The attachment of claim 14, wherein the nozzle is configured to produce, through an outlet opening of the nozzle, an airflow having a toroidal shape.

22. The attachment of claim 14, wherein the one or more vanes are disposed within a rotating member that is rotatably coupled to the tubular adapter.

23. The attachment of claim 14, wherein the one or more vanes are integrally formed within the tubular adapter, and the nozzle is rigidly attached the tubular adapter.

24. The attachment of claim 22, wherein the rotating member is secured to an outside portion of the attachment via at least a shaft.

25. A method for directing airflow of a hair dryer with an attachment, the method comprising:

A) receiving, in an inlet opening of a tubular adapter, an airflow from the hair dryer, B) directing the airflow to rotate one or more vanes disposed and housed within the tubular adapter, the airflow being directed through an outlet opening of the tubular adapter and into an inlet opening of an angular frusto-conical nozzle having a truncated oblique conical shape, causing the nozzle to rotate; and C) further directing the airflow through an outlet opening of the nozzle, wherein the outlet opening of the nozzle is ovular in shape.

26. The method of claim 25, wherein the airflow exiting the outlet opening of the nozzle has a moving, rotating pattern of heated air flow comparable to that achieved when an operator manually manipulates the hair dryer relative to hair to be dried.

27. The method of claim 25, further comprising reducing a temperature of an outside portion of the attachment with the tubular adapter.

28. The method of claim 25, wherein a configuration of the nozzle and one or more vanes cause a pulsating airflow from the outlet by rotating the nozzle at a speed of between 1500 RPM and 2500 RPM.

* * * * *

UNITED STATES PATENT AND TRADEMARK OFFICE

CERTIFICATE OF CORRECTION

PATENT NO. : 8,732,976 B2
APPLICATION NO. : 13/720299
DATED : May 27, 2014
INVENTOR(S) : Han et al.

It is certified that error appears in the above-identified patent and that said Letters Patent is hereby corrected as shown below:

On the Title Page, Item (73) Assignee "Fort Washington" should be "Port Washington."

Signed and Sealed this
Nineteenth Day of August, 2014

Michelle K. Lee

Michelle K. Lee
*Deputy Director of the United States Patent and Trademark Office*